US007932804B2

(12) United States Patent
Buettner

(10) Patent No.: US 7,932,804 B2
(45) Date of Patent: Apr. 26, 2011

(54) SWITCHING DEVICE, PARTICULARLY FUSE SWITCH DISCONNECTOR

(75) Inventor: Alex Buettner, Roedental (DE)

(73) Assignee: Woehner GmbH & Co.. KG Elektrotechnische Systeme, Roedental (DE)

( * ) Notice: Subject to any disclaimer, the term of this patent is extended or adjusted under 35 U.S.C. 154(b) by 176 days.

(21) Appl. No.: 12/299,706

(22) PCT Filed: Apr. 26, 2007

(86) PCT No.: PCT/EP2007/054100

§ 371 (c)(1),
(2), (4) Date: Feb. 12, 2009

(87) PCT Pub. No.: WO2007/131868

PCT Pub. Date: Nov. 22, 2007

(65) Prior Publication Data

US 2009/0231082 A1 Sep. 17, 2009

(30) Foreign Application Priority Data

May 12, 2006 (DE) ..... 10 2006 022 374

(51) Int. Cl.
*H01H 85/22* (2006.01)
*H01H 71/20* (2006.01)

(52) U.S. Cl. ..... 337/196; 337/181; 337/209

(58) Field of Classification Search ..... 337/181, 337/196, 209
See application file for complete search history.

(56) References Cited

U.S. PATENT DOCUMENTS

| | | | | | |
|---|---|---|---|---|---|
| 743,471 | A | * | 11/1903 | Downes | 337/196 |
| 1,158,535 | A | * | 11/1915 | Murray | 337/196 |
| 1,429,275 | A | * | 9/1922 | Burnham | 337/196 |
| 1,857,442 | A | * | 5/1932 | Dohrwardt | 337/196 |
| 1,953,343 | A | * | 4/1934 | Frank | 337/194 |
| 1,954,186 | A | * | 4/1934 | Steinmayer | 337/196 |
| 1,966,716 | A | * | 7/1934 | Green | 337/194 |
| 1,993,866 | A | * | 3/1935 | Steinmayer | 337/203 |
| 2,011,391 | A | * | 8/1935 | Bennett | 337/196 |
| 2,011,543 | A | * | 8/1935 | Meyer | 337/212 |
| 2,026,381 | A | * | 12/1935 | Fiedler | 337/206 |
| 2,077,207 | A | * | 4/1937 | Birkenmaier | 337/152 |
| 2,098,559 | A | * | 11/1937 | Anderson | 337/196 |
| 2,361,666 | A | * | 10/1944 | Triplett | 337/240 |
| 2,379,199 | A | * | 6/1945 | Triplett | 337/180 |
| 2,404,230 | A | * | 7/1946 | Harlow et al. | 337/196 |
| 2,700,712 | A | * | 1/1955 | Stinson | 337/193 |
| 2,905,791 | A | * | 9/1959 | Edmunds | 337/199 |
| 4,778,959 | A | * | 10/1988 | Sabatella et al. | 218/1 |
| 6,727,797 | B1 | * | 4/2004 | Bruchmann | 337/210 |

FOREIGN PATENT DOCUMENTS

DE 79 35 055 U1 4/1980

(Continued)

*Primary Examiner* — Anatoly Vortman
(74) *Attorney, Agent, or Firm* — Sughrue Mion, PLLC

(57) ABSTRACT

The invention relates to a switching device, in particular fused interrupters, including a housing and a cover arranged thereon, wherein in the housing at least one pair of contacts is provided for receiving respectively one contact blade of a safety device or the like, wherein each contact is electrically connected to an input or output contact element, and one contact of each contact pair has a base section as an input contact which projects from the housing on the underside thereof, including an adapter arranged on the bottom side of the switching device which has two contact gaps per base section for alternative contacting and which is provided for attaching to conductor rails.

15 Claims, 6 Drawing Sheets

FOREIGN PATENT DOCUMENTS

| | | | |
|---|---|---|---|
| DE | 31 19 957 | A1 | 12/1982 |
| DE | 40 03 260 | C2 | 8/1991 |
| DE | 297 21 440 | U1 | 4/1998 |
| DE | 298 22 620 | U1 | 3/1999 |
| DE | 299 08 804 | U1 | 8/1999 |
| RU | 2125317 | C1 | 1/1999 |

* cited by examiner

SWITCHING DEVICE, PARTICULARLY FUSE SWITCH DISCONNECTOR

CROSS REFERENCE TO RELATED APPLICATION

This application is a National Stage of International Application No. PCT/EP2007/054100 filed Apr. 26, 2007, claiming priority based on German Patent Application No. 10 2006 022 374.8, filed May 12, 2006, the contents of all of which are incorporated herein by reference in their entirety.

BACKGROUND OF THE INVENTION

1. Field of the Invention

The invention relates to a switching device, in particular a fuse switch disconnector, comprising a housing and a lid arranged thereon, in which at least one pair of contacts is provided in the housing for receiving respectively one contact blade of a fuse unit, wherein each contact is electrically connected to an input or output contact element.

2. Related Art

Switching devices, in particular fuse switch disconnectors, comprise a housing having a lid, which is preferably pivotably hinged thereto. Depending on the number of poles, contacts having input and output contact elements respectively for receiving fuse units are located in the housing. Here, the fuse units are preferably pivotably arranged along with the lid so that the fuse units are removed from the associated contacts when opening the lid. Such a switching device is known from DE 297 21 440, for example. The housing having the contacts for contacting the contact blades of the fuse units is preferably arranged on busbars by means of an adapter. Here, cylindrical contact elements, which are on one side in electrical contact with respectively one connecting bar, which in turn may be brought into electrical contact with one of the busbars, serve to establish an electrical contact between the input contact elements and the associated busbar. The output contact element serves to mount an end of the line.

In such switching devices it is necessary to pay attention to a preset connection direction, i.e., when the switching device is attached to the busbars, which are horizontally arranged and extend in parallel on top of each other, the output contacts are regularly located at the lower side. It is not possible to change the connection direction of the switching device with regard to the output contacts thereof.

Switching devices of said kind are known as mounting devices and busbar devices. Mounting devices are mounted on a mounting plate or are also snapped onto a mounting rail. In addition, the switching device has separate input and output contacts, to which electrical lines are clamped. Switching devices in the form of busbar devices, as described above, are attached to busbars and conductor rails respectively and therefore exclusively have connection points and output contacts respectively for the output lines. Here, the input supply (feeding) is carried out by means of the previously described contacting of the busbars.

Depending on the concept of the control cubicle and the country-specific standard, output lines leading downwards, but also output lines leading upwards are required. Therefore, in the known switching devices different kinds of housings are required, depending on whether the output contacts are to be accessible from below or from above.

BRIEF SUMMARY OF THE INVENTION

The invention is based on the object to provide a switching device, in particular a fuse switch disconnector, in which the connection direction of the output contacts can be changed.

According to the invention, said object is achieved in that one contact of each contact pair comprises as input contact a base section, which is led downwards from the housing through an opening in the bottom of the housing and projects from the housing at the lower surface thereof, comprising an adapter, which is arranged at the lower side of the switching device, has two contact gaps for alternative contacting by the base section and includes a contact rail comprising contacting portions for contacting by the base section in the area of the contact gaps, wherein the adapter is configured to be attached to conductor rails.

One embodiment is characterized in that the pairs of openings located at the top of the adapter are aligned with respect to the contacts so that the housing rotated by 180° can be attached to the adapter in case of concurrent contacting between the base section and one of the contacting portions of the contact rail.

Another embodiment is characterized in that the base section is formed as plug-in contact.

Another embodiment is characterized in that the base section is formed by spring-elastic arms.

Another embodiment is characterized in that the base section is formed by at least one plug-in tongue.

Another embodiment is characterized in that the housing comprises two pairs of holders, which are alternatively provided as lid support for pivotally supporting the lid.

Another embodiment is characterized in that the holders are formed as hinge pins for receiving an arm, at the end of which a slot or the like is provided and which is attached to the lid.

Another embodiment is characterized in that the contacts are formed symmetrically to a central line of the housing.

Another embodiment is characterized in that an adapter part is provided, which comprises at its top pairs of openings located symmetrically to each other for electrically contacting contact regions, which are a component part of a contact rail arranged in the adapter.

Another embodiment is characterized in that each contact rail defines an arm extending substantially parallel to the axis of the adapter, at which the contact regions are formed.

Another embodiment is characterized in that the input contact formed as base section is attached to or inserted into the contact rail when the housing is attached to the adapter.

Another embodiment is characterized in that each contact rail comprises predetermined regions for contacting by the input contact.

Another embodiment is characterized in that the predetermined regions are rounded.

Another embodiment is characterized in that the predetermined regions comprise slots.

Another embodiment is characterized in that the plug-in contact is connected to the base section via a shoulder portion.

Another embodiment is characterized in that the receiving region of the plug-in contact is formed in parallel and offset with respect to the base section for contacting the blade of the associated fuse unit.

The invention provides a switching device, in which the connection direction can be made both downwards and upwards so that different types of housings are not required and the desired connection situation can be conceived correspondingly on the premises at any time.

In particular, the switching device according to the invention enables the output contacts to be adjustable in a state either facing downwards or upwards by corresponding positioning of the housing. In the switching device according to the invention a contact, namely the input contact, is formed so as to comprise a base section projecting beyond the lower surface of the housing and serving as plug-in contact so that the housing in a first position and a second position rotated by 180° with respect to the first position, depending on where the output contacts are to be located, can be attached to the adapter element, thereby establishing an electrical contact between the plug-in contact and the associated contact rail element in the adapter.

In a preferred embodiment the housing is provided with two pairs of holders for supporting the lid so that in each case, depending on the positioning of the housing of the switching device, the lid can be hinged and pivotally mounted to the housing respectively in the proper position.

According to a preferred embodiment, the adapter is provided with one contact rail per pole, each comprising two alternative contact regions so as to be contactable by the plug-in contact of the associated pole in the housing. In the area of said contact regions the adapter opens towards the housing of the switching device to enable the plug-in contact to be put therethrough.

In a first embodiment the plug-in contact is provided with spring-elastic contact arms, which are attached to, for example, a tapered region at the contact rail of the adapter. In another embodiment the plug-in contact is fitted with at least one, preferably several, plug-in tongue(s) in the area of the base section, which can be plugged in corresponding gap-shaped openings of the contact rail in the adapter.

In order to explain further features, preferred embodiments of the switching device according to the invention will be described below in conjunction with the drawings, in which:

DETAILED DESCRIPTION OF THE INVENTION

The switching device according to the invention will be explained in further detail below by means of the drawings.

Figure 1:
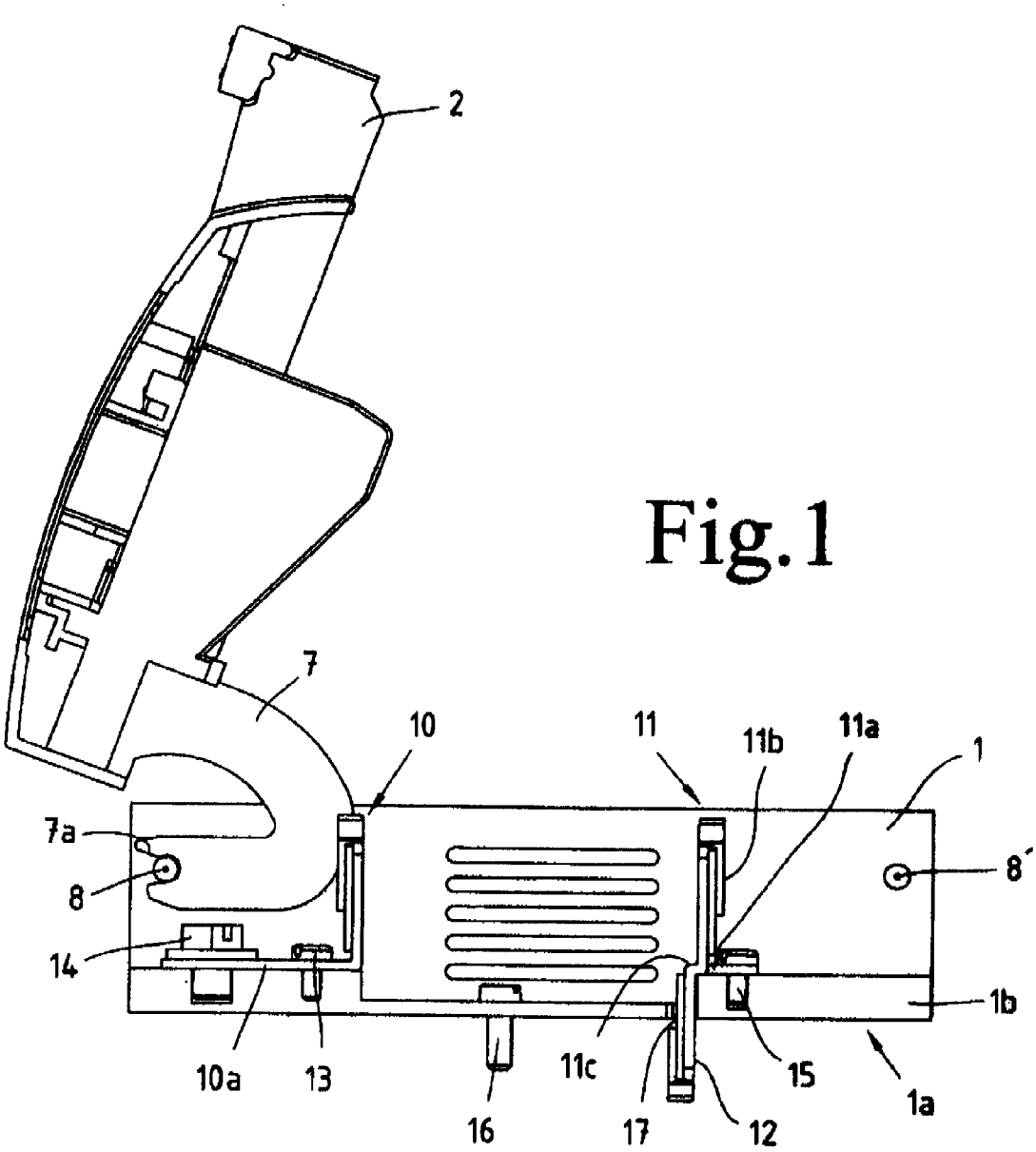
FIG. 1 is a sectional view of the switching device according to the invention to show the arrangement of the contacts clearly.
Figure 2:
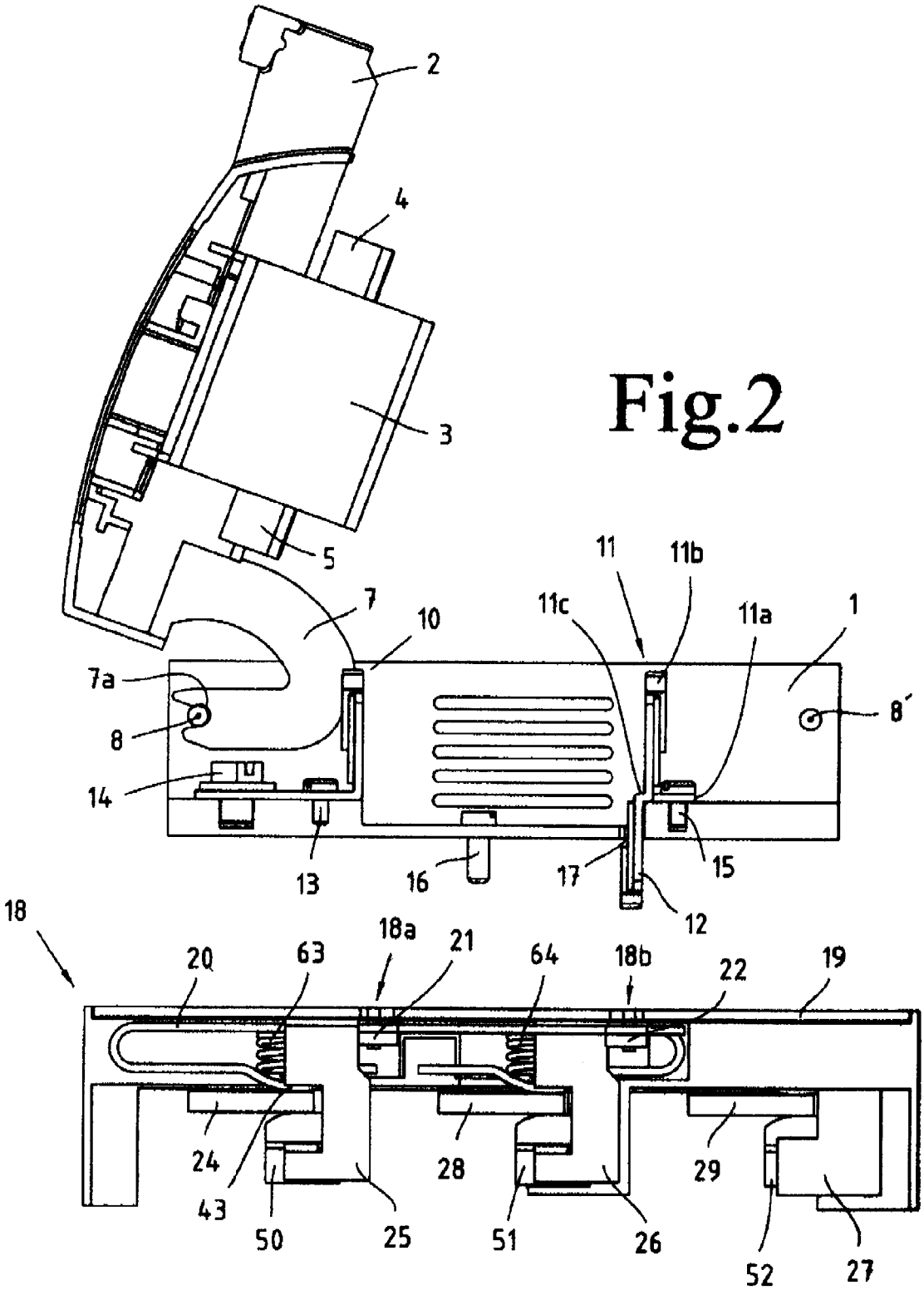
FIG. 2 is a view of the switching device according to FIG. 1 along with an adapter.

FIG. 1 shows the switching device comprising a housing 1 and a lid 2 preferably pivotally hinged to the housing 1. As is known from DE 297 21 440, the lid 2 serves to receive one or more fuse unit(s). Such fuse units comprise contact blades for contacting the contacts to be described below in the housing 1. In FIG. 2 said fuse unit is designated by 3 and the contact blades are indicated by 4 and 5.

As can be seen from FIGS. 1 and 2, the lid 2 is pivotally mounted to the holders 8 by swivel feet 7, wherein the holders 8 are preferably provided in the form of receiving pins or the like. Two pairs of such holders 8, 8' are located at the inside of the housing 1, which serve to mount the lid either to the pair of holders 8 or the pair of holders 8', depending on how the housing is arranged with regard to the associated adapter 18 still to be described. The housing 1 is usually located in vertical direction so that the lid 2 is arranged in such a way that the lid can be pivotally opened "upwards".

In a three-pole switching device three pairs of contacts 10, 11 are located in the housing, which are provided opposite to each other and serve to receive the contact blades 4, 5 of the respective fuse unit 3 when the lid 2 is moved in a direction towards the housing 1 and closed.

In the embodiment shown in FIGS. 1 and 2 an output contact is provided in the form of the contact 10 and an input contact 11 is provided in the form of a plug-in contact, as is to be explained in further detail below. The plug-in contact 11 comprises a base section 12 led downwards from the housing 1 through an opening 17 in the bottom 1*b* of the housing and protruding over a preset distance with respect to the lower surface 1*a* of the housing. In the illustrated embodiment the output contact 10 is substantially and preferably L-shaped, mounted opposite the bottom 1*b* of the housing by screwing means 13 and in addition supports a clamping screw 14 for clamping a line end or the like thereto on the arm 10*a* extending parallel to the plane of the housing. The plug-in contact 11 is mounted to the bottom of the housing 1 by means of an arm 11*a* projecting perpendicularly to the base section 12 and by means of screwing means.

In the embodiment shown in FIGS. 1 and 2 the plug-in contact 11 is formed so that the base section 12 is arranged to be offset in parallel with respect to the receiving portion 11*b* thereof for contacting the blade of the associated fuse unit 3 by forming a shoulder portion 11*c* between the portion 11*b* and the contact portion 12. In detail, reference is explicitly made to FIG. 1.

The shoulder portion 11*c* bears on the bottom 1*b* of the housing 1. In the bottom 1*b* of the housing there is located an opening 17, through which the base section 12 of the plug-in contact 11 is led. Furthermore, screwing means 16 are provided in the bottom 1*b* of the housing, which serve to enable the housing 1 to be mounted to the underlying adapter 18.

As results from FIGS. 1 and 2, the contact blades 4, 5 enter the contacts 10, 11 associated with the receiving regions 10*b*, 11*b* upon closing the lid 2, whereby an electrical connection is established between the input contact in the form of a plug-in contact 11 and the output contact 10.

The switching device according to the invention is attached to the adapter 18, wherein the base section 12 of the plug-in contact 11 engages predetermined regions or contacting portions 21, 22 of a contact rail 20 via one of respectively one pair of openings 18*a*, 18*b*, and, so that the electrical contact between the base section 12 and the contact rail 20 is established, which is done when attaching the housing 1 to the adapter 18.

In the embodiment shown in FIGS. 1 and 2 the contact rail 20 is provided with two defined contact portions 21, 22, as will be explained in detail below. When the housing 1 according to FIGS. 1 and 2 is attached to the adapter 18, the base section 12 contacts the region 22 of the contact rail 20, which itself can be brought into electrical connection with one of the busbar and conductor rail respectively denoted by 24, 28, 29.

The adapter 18 further comprises feet 25, 26, 27 for partially engaging under the associated busbars 24, 28, 29 in order to enable the adapter 18 to be attached to the busbars 24, 28, 29, as is known per se.

Figure 3A:
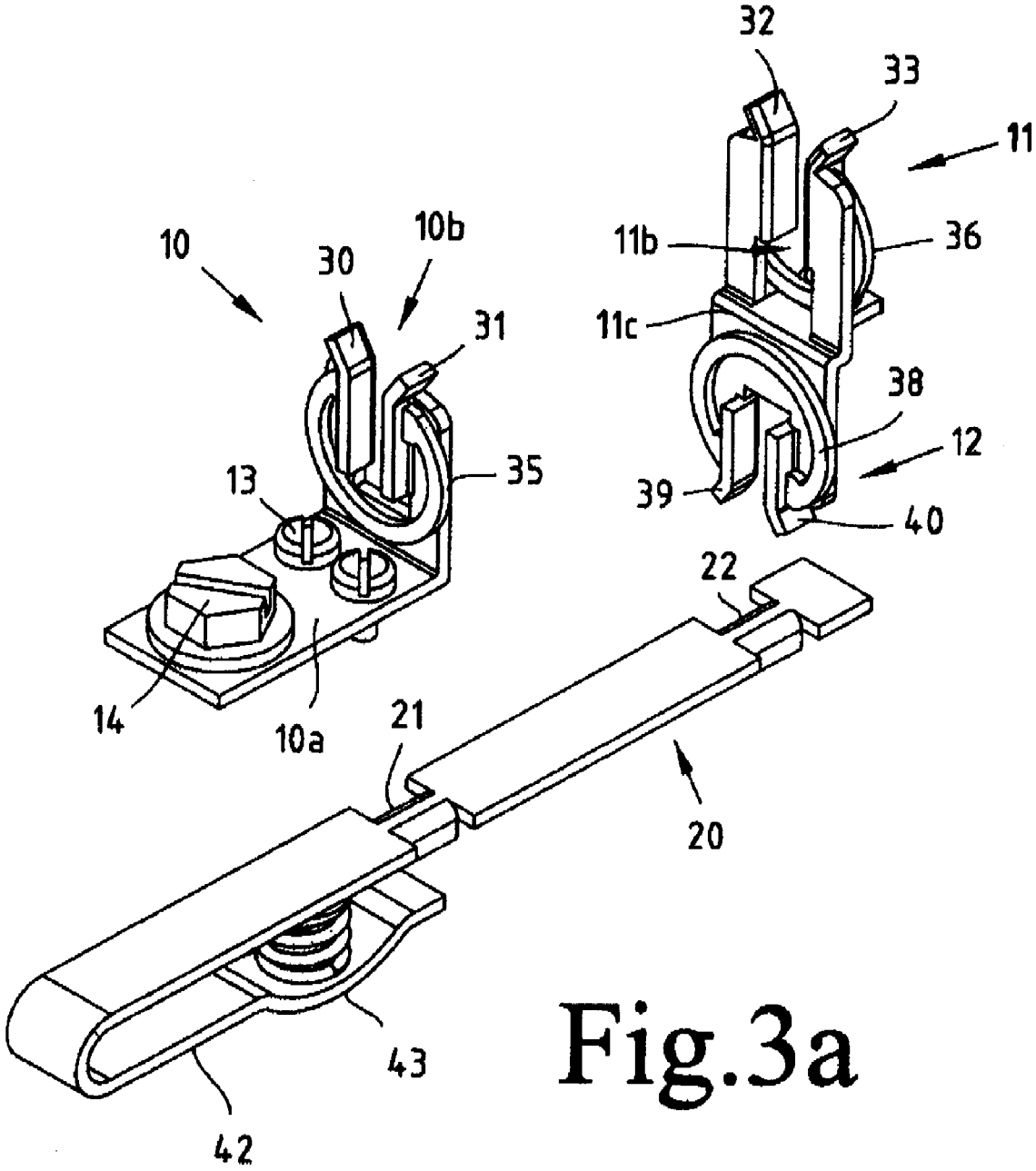
FIG. 3*a* is a detailed view of the input and output contacts as well as the associated contact rail extending in the adapter.

FIG. 3*a* shows a first embodiment of the contacts 10, 11 used in accordance with the invention and the contact rails 20 of the adapter 18. Each contact 10, 11 is provided with contact arms 30, 31 and 32, 33 respectively in a manner known per se, which are biased in a clamping position by a lock washer 35 and 36 respectively, as is also known per se. The contact arms 30, 31 and 32, 33 respectively extend substantially parallel to each other and support insertion regions widening upwards. The arms 30, 31 and 32, 33 respectively are engaged behind by respectively one lock washer 35 and 36 respectively.

At the lower surface of the plug-in contact 11 there is located the base section 12, which in this embodiment and in accordance with the upper contact portion is formed with the parts 32, 33, 36 and also comprises a lock washer 38.

The contact rail 20 comprises widthwise shortened regions 21, 22, which are preferably conical or chamfered and round respectively, in order to enable easy attachment of the plug-in contact 11 with the base section 12 thereof. For this purpose, the arms 39, 40 of the base section 12 are also bent laterally, whereby attaching the arms 39, 40 to the portion 21 and 22 respectively is eased.

The contact rail 20 comprises a tongue 42 bent downwards and ending in an arc 43 arched downwards. The arc 43 is for contacting the associated conductor rail, as can be seen from FIG. 2.

FIG. 3*a* shows a view according to FIG. 3*a*, wherein, however, the plug-in contact 11 is attached to the contact rail 20 and the guiding arms 39, 40 widening downwards are slid over the portion 22. Therefore, the plug-in contact 11 is in electrical connection with the contact rail 20.

Figure 4:
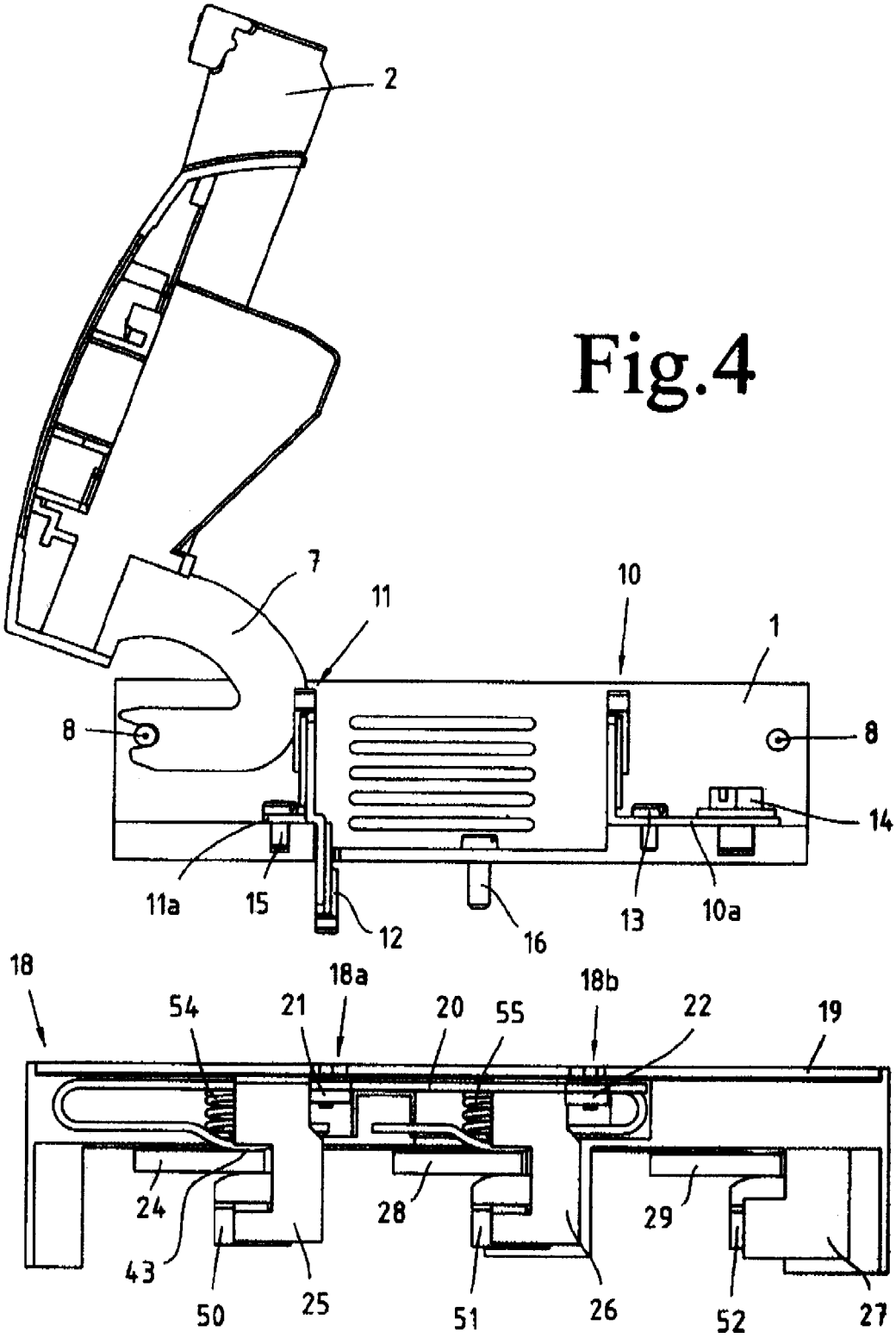
FIG. 4 is an illustration in accordance with FIG. 2, in which the housing is rotated by 180° with regard to FIG. 2.

FIG. 4 shows an illustration according to FIG. 2, in which, however, the housing 1 is rotated by 180° with regard to FIG. 2 so that the plug-in contact 11 in FIG. 4 is located on the left side of the housing 1, i.e. close to the lid 2, in contrast to FIGS. 1 and 2. In the embodiment according to FIG. 4 the lid 2 is attached to and pivotably supported around the holders 8'. By arranging the holders 8, 8' in pairs it is therefore possible to mount the lid 2 either to the holders 8 or alternatively and according to FIG. 4 to the holders 8' so that the housing 1 rotated by 180° with respect to FIGS. 1 and 2 can be provided, whereby the output contacts are located in the direction opposite to the direction of FIGS. 1, 2.

In the embodiment according to FIGS. 1 and 2 the output contacts are located "at the top", i.e. in the area where the lid 2 is mounted, whereas in the embodiment according to FIG. 4 the output contacts 10 are located "at the bottom", i.e. at the side facing away from the lid 2.

When the housing 1 according to FIG. 4 is attached to the adapter 18, the base section 12 contacts the region 21 having the same design as the region 22 according to FIG. 3*a*, wherein openings 18*a*, 18*b* are formed in the adapter 18 both above the region 21 and the region 22 so as to enable the plug-in contact 11 to be inserted correspondingly.

The switching device according to the invention comprises respective contacts 10, 11 per pole. As can be seen in FIGS. 2 and 4, there is provided respectively one contact rail 20 per pole and per conductor rail 24, 28, 29 respectively. The illustrated embodiment is a three-pole switching device for use on the busbars.

From the previous explanation it is obvious that the housing 1 may be attached as desired or required without any problem in a state in which it is rotated by 180° to locate the output contacts once either "at the top" or "at the bottom".

Figure 5:
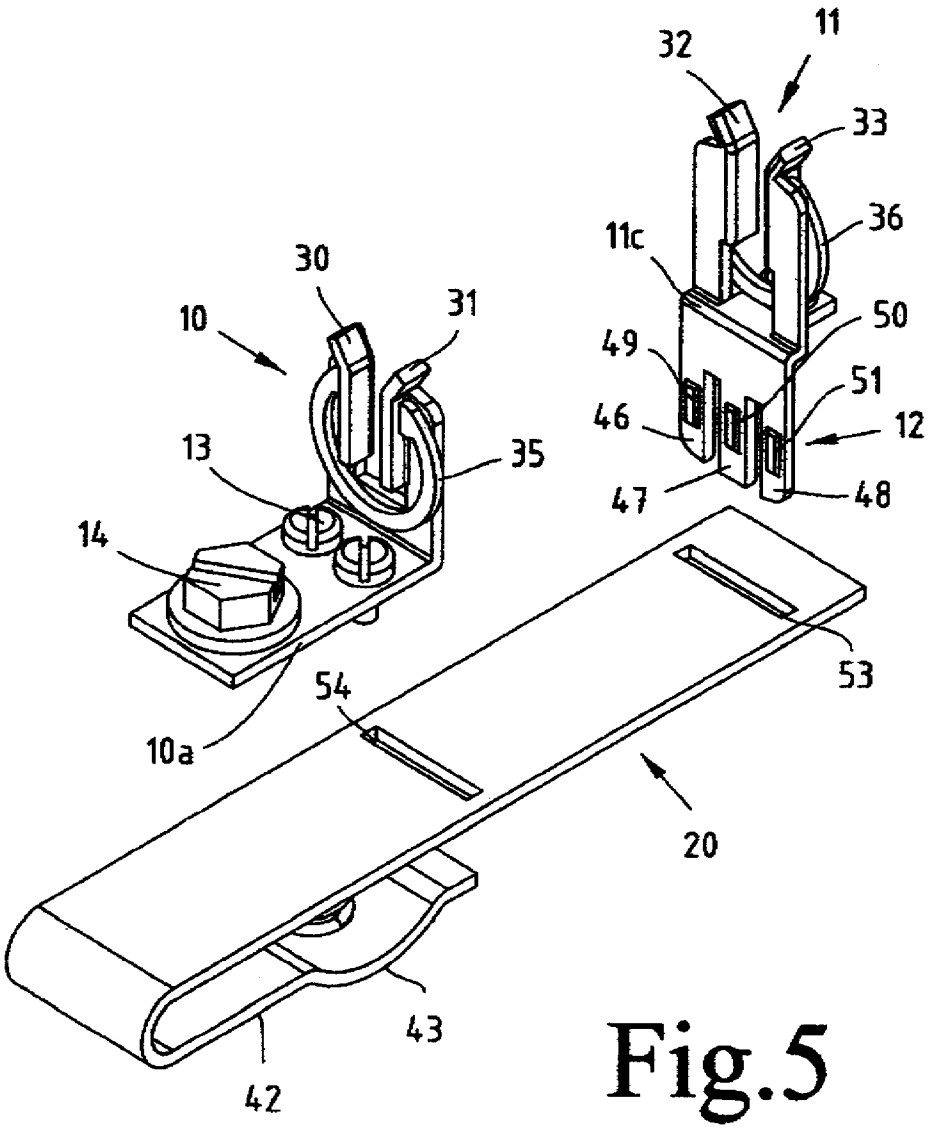
FIG. 5 is an illustration of the input and output contacts and the associated contact rail to illustrate an embodiment modified with regard to FIG. 3.

With respect to the embodiment according to FIG. 3*a*, FIG. 5 shows a modified embodiment of the contacts 10, 11 and the contact rail 20. In this embodiment the contact 10 is the same as that of the previous embodiment and the plug-in contact 11 differs from that of the previous embodiment in that the base section 12 is formed by at least one, preferably three, plug-in tongues 46, 47, 48, each of which may comprise at least one projection 49, 50, 51 projecting laterally. A pair of slots 53, 54 corresponding to the width of the plug-in tongue and plug-in tongues respectively is formed in the contact rail 20 for receiving the plug-in tongue(s). It is possible to turn round the housing 1 according to the previous explanation, i.e. the plug-in contact 11 can either be inserted into the slot 54 or the slot 53. The slots 53, 54 are slightly larger than the thickness of the contact tongues 46, 47, 48, wherein, after insertion of the plug-in contact 11, the projections or ridges 49, 50, 51 prevent the plug-in contact 11 from being removed unintentionally from the slots 53 and 54 respectively.

In the contact rail 20 there may also be provided one respective slot for each plug-in tongue instead of the continuous slots 53, 54.

The contact rails 20 are preferably made of a flat copper ribbon to ensure the spring properties required for the contacting of the busbars. In the embodiment according to FIG. 3*a* the regions 21, 22 are bent to a predetermined extent into an approximately U-shape in order to ease sliding the clamping arms 39, 40 thereon.

Although in the previously described embodiment the holders 8, 8' are provided as hinge pins projecting from the inner wall of the housing towards the interior of the housing, another design than the illustrated one may also be used for pivotally supporting the lid 2.

Figure 3B:
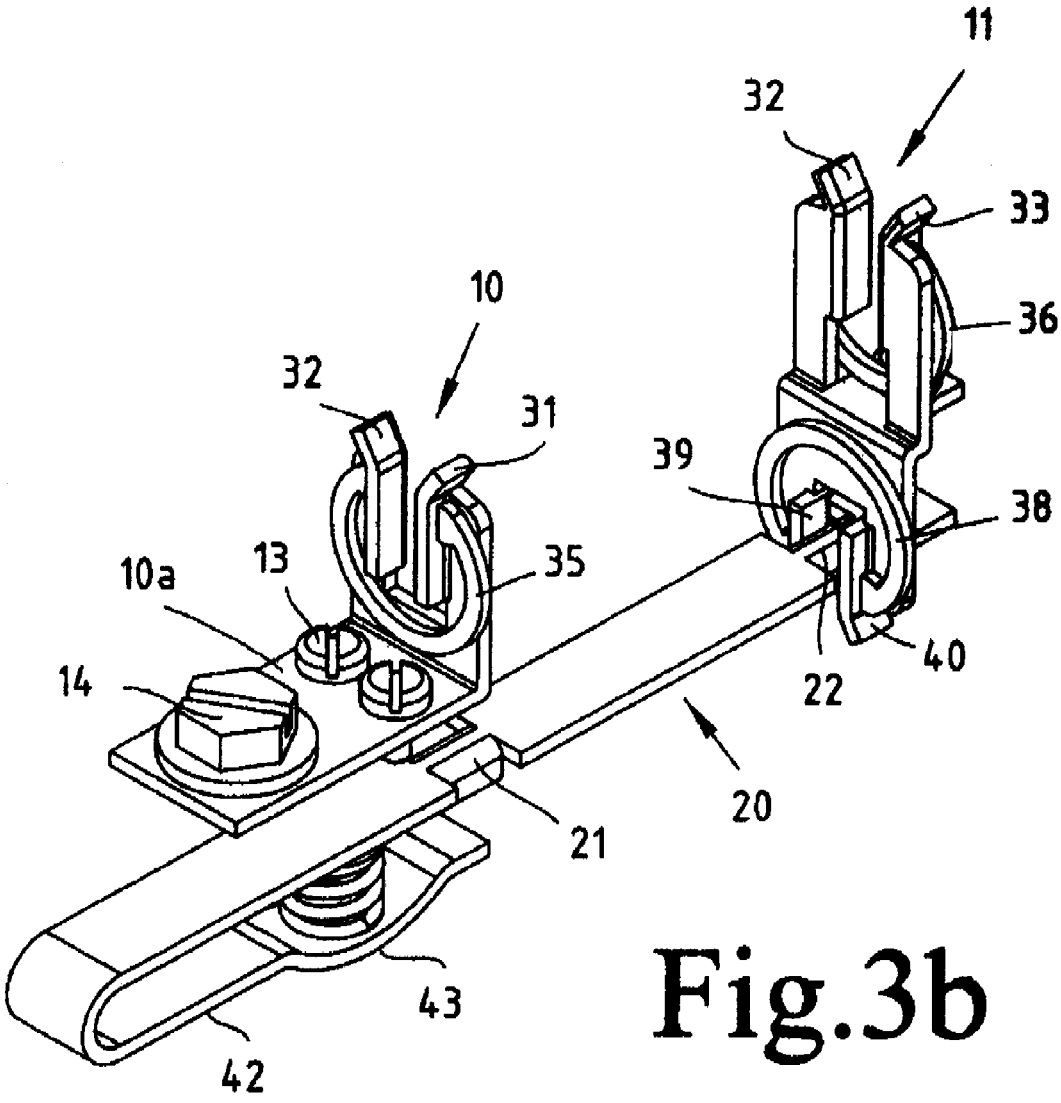
FIG. 3*b* is an illustration in accordance with FIG. 3*a*, in which the plug-in contact is attached to the contact rail.

The embodiment of the plug-in contact 11 shown in FIG. 5 has the advantage that the plug-in tongues are provided without separate spring means, i.e. the lock washer 38 used with respect to FIGS. 3*a*, 3*b* is omitted and the contact rail 20 merely requires to be formed with slots and pairs of slots 53, 54 respectively compared with the formation of the particularly processed narrowed regions 21, 22 in the alternative embodiment according to FIG. 3*a*.

In the switching device according to the invention the housing 1 is made of a preferably rectangular or square body of plastics comprising a bottom 1*b* of the housing for receiving several, preferably three, contact pairs 10, 11 with the previously described input and output contacts. The individual contact pairs 10, 11 are formed in chambers isolated from one another by partition walls, as is known per se, so that the individual fuse units are separated from each other by the partition walls when the lid 2 is closed. The housing 1 is open-topped so as to receive the fuse units inserted in the lid 2 while closing the lid 2. Although not further described in the figures, the lid 2 itself comprises means for fixing the fuse units 3 so that the fuse units 3 come to be located next to each other in parallel and accordingly can be inserted simultaneously into the associated contacts 10, 11 with their contact blades 4, 5 while closing the lid.

The lower surface of the housing 1 is merely opened in the area of the plug-in contact 11 and for receiving the screwing means 14. Except for the openings 18*a*, 18*b* for the regions 21, 22 and for the thread holes for the screwing means 16, the adapter 18 is close-topped. At its lower surface the adapter 18 is fitted with clamping feet 25, 26, 27, which are made of an insulating material, in particular plastics, and are able to support the compensation elements 50, 51, 52 where required to enable the adapter 18 to be used at conductor rails 24, 28, 29 of different thicknesses.

Openings are formed on the lower surface of the adapter 18 so that the arc-shaped contact pieces 43 of the individual contact rails 20 slightly project from the lower surface of the adapter 18 for the purpose of contacting the conductor rails 24, 28, 29 upon attaching the adapter 18 to said conductor rails 24, 28, 29. As shown in the figures, said contact regions can be biased by springs 63, 64.

Both the lid 2 and the housing 1 and the housing of the adapter 18 are made of insulating material, in particular plastics. The live parts, as for example the contact rail 20 and the contacts 10, 11, are preferably made of copper material.

The arrangement of the contact rails 20 in the adapter 18 is made so that in a three-pole switching device a total of three contact rails 20 are provided next to each other in parallel in the adapter 18 according to the three pairs of contacts 10, 11 in the housing 1.

In the illustrated embodiment the contacts 10, 11 are provided symmetrically to a centre line, whereas the contact rails 20 are formed parallel to each other, but to be offset in terms of the contact regions 43 in the longitudinal direction of the adapter 18 to be able to respectively contact the individual conductor rails 24, 28, 29. The contact regions 21, 22 are also located symmetrically to a central axis of symmetry, whereby it is ensured that the housing 1 is attachable to the adapter 18 both in the position shown in FIG. 2 and the position shown in FIG. 4, thereby ensuring a contact between the plug-in contact 11 and the contact rail 20 with the predetermined contact regions 20, 21.

Thus, the contact rails 20 located in the adapter 18 parallel to each other definitely may have different lengths, however, the preset contact regions 21, 22, according to the arrangement of the contacts 10, 11 in the housing 1, are located in alignment with each other and are therefore also located mirror symmetrically to an imagined centre line.

Unlike the contact rail 20 described in conjunction with FIGS. 3*a* and 3*b*, the contact rail over its length of the arm, which is located above the tongue 42, including the contact regions 21, 22 can be formed continuously with a shape and width corresponding to those of the contact regions 21, 22 i.e., that the contact rail over the length of the whole arm is correspondingly formed narrow and rounded, as the regions 21, 22 in FIG. 3*a*. If the contact rail 20 has the same shape and configuration, i.e. arc-shaped flattenings when seen in cross section, over the total length including the regions 21, 22, the manufacture of the contact rail 20 might be simplified.

The contact rails 20 provided in the adapter 18 extend parallel to each other and towards the axis of the adapter 18. The arm of the contact rail receiving the contact regions 21, 22 extends in the adapter 18 slightly below an upper cover or wall of the adapter 18, which is denoted by 19. In said cover or wall 19 the pairs of openings 18*a*, 18*b* are located, the number of which corresponds to the number of poles of the switching device, i.e., respectively one pair of openings 18*a*, 18*b* is located above the respective contact rail 20 to enable the base section 12 to have access to the contact rail 20, namely both in the position of the housing 1 according to FIG. 2 and in the position of the housing according to FIG. 4.

In the illustrated embodiment there is respectively provided one spring means 63, 64 between the arm of the contact rail 20, which extends parallel to the cover or wall 19 of the adapter 18 and includes the contact regions 21, 22, and the tongue 42 and the arc-shaped contact region 43 respectively in order to bias the arc-shaped contact region 43 towards the conductor rails 24, 28, 29.

The invention claimed is:

1. A switching device, in particular a fuse switch disconnector, comprising a housing and a lid arranged thereon, in which at least one pair of contacts is provided in the housing for respectively receiving one contact blade of a fuse unit, wherein each contact is electrically connected to an input or an output contact element, characterized in that one contact of each contact pair comprises as an input contact a base section led downwards from the housing through an opening in a bottom of the housing and projecting from the housing at the lower surface thereof, wherein the housing can be attached to an adapter in different connection directions, wherein the adapter is arranged at the lower side of the switching device, and comprises two contact gaps for alternative contacting by the base section, and includes a contact rail comprising contacting portions in the area of the contact gaps for contacting by the base section, and wherein the adapter is configured to be attached to the conductor rails.

2. The switching device according to claim 1, characterized in that the two contact gaps are located at the top of the adapter and are aligned with respect to the contacts so that the housing rotated by 180° can be attached to the adapter in case of concurrent contacting between the base section and one of the contacting portions of the contact rail.

3. The switching device according to claim 1, characterized in that the base section is formed as plug-in contact.

4. The switching device according to claim 1, characterized in that the base section is formed by spring-elastic arms.

5. The switching device according to claim 1, characterized in that the base section is formed by at least one plug-in tongue.

6. The switching device according to claim 1, characterized in that the housing comprises two pairs of holders, which are alternatively provided as a lid support for pivotally supporting the lid.

7. The switching device according to claim 6, characterized in that the holders are formed as hinge pins for receiving an arm, at the end of which a slot is provided and which is attached to the lid.

8. The switching device according to claim 1, characterized in that the contacts are formed symmetrically to a central line of the housing.

9. The switching device according to claim 1, characterized in that said two contact gaps are provided at the top of the adapter and are located symmetrically to each other for electrical contacting the contacting portions.

10. The switching device according to claim 1, characterized in that each contact rail defines an arm extending substantially parallel to the axis of the adapter, at which the contacting portions are formed.

11. The switching device according to claim 1, characterized in that, when the housing is attached to the adapter, the input contact element formed as base section is attached to and inserted in the contact rail respectively.

12. The switching device according to claim 11, characterized in that the contact portions are rounded.

13. The switching device according to claim 1, characterized in that the contact portions comprise slots.

14. The switching device according to claim 1, characterized in that one contact of each contact-pair is formed by a plug-in contact and is connected with the base section via a shoulder portion.

15. The switching device according to claim 13, characterized in that one contact comprises a receiving portion which is parallel and offset with regard to the base section for contacting the contact blade of the associated fuse unit.

* * * * *